US008446334B2

(12) United States Patent
Azulay

(10) Patent No.: US 8,446,334 B2
(45) Date of Patent: May 21, 2013

(54) MULTI-ANTENNA MULTIBAND SYSTEM

(75) Inventor: Snir Azulay, Tiberias (IL)

(73) Assignee: Galtronics Corporation Ltd., Tiberias (IL)

( * ) Notice: Subject to any disclaimer, the term of this patent is extended or adjusted under 35 U.S.C. 154(b) by 397 days.

(21) Appl. No.: 12/810,402

(22) PCT Filed: May 23, 2010

(86) PCT No.: PCT/IL2010/000407

§ 371 (c)(1),
(2), (4) Date: Jun. 24, 2010

(87) PCT Pub. No.: WO2010/134081

PCT Pub. Date: Nov. 25, 2010

(65) Prior Publication Data

US 2011/0148732 A1 Jun. 23, 2011

Related U.S. Application Data

(60) Provisional application No. 61/180,472, filed on May 22, 2009, provisional application No. 61/270,200, filed on Jul. 2, 2009.

(51) Int. Cl.
*H01Q 21/00* (2006.01)
*H01Q 1/24* (2006.01)

(52) U.S. Cl.
USPC ..... 343/853; 343/700 MS; 343/848

(58) Field of Classification Search
USPC ..... 343/700 MS, 702, 846, 848, 853, 343/893
See application file for complete search history.

(56) References Cited

U.S. PATENT DOCUMENTS

| | | | | |
|---|---|---|---|---|
| 5,684,672 | A | 11/1997 | Karidis et al. | |
| 7,467,973 | B2 | 12/2008 | Lee et al. | |
| 7,825,863 | B2 * | 11/2010 | Martiskainen et al. | 343/702 |
| 8,013,254 | B2 | 9/2011 | Lee et al. | |
| 2006/0017626 | A1 * | 1/2006 | Kannan et al. | 343/702 |
| 2007/0205946 | A1 * | 9/2007 | Buris et al. | 343/700 MS |
| 2007/0281631 | A1 | 12/2007 | Nast | |
| 2008/0180333 | A1 | 7/2008 | Martiskainen et al. | |
| 2008/0297422 | A1 | 12/2008 | Ishida | |
| 2009/0316612 | A1 | 12/2009 | Poilasne et al. | |

FOREIGN PATENT DOCUMENTS

| | | |
|---|---|---|
| WO | WO 2008/059509 | 5/2008 |
| WO | WO 2010/134081 | 11/2010 |

OTHER PUBLICATIONS

Sayanagi et al., "A low loss flexible stripline for 1.9GHz Antenna", IEMT/IMC Proceedings, 1997, Kyoto, Japan.
An International Search Report and a Written Opinion, both dated Sep. 14, 2010, which issued during the prosecution of Applicant's PCT/IL10/00407.

* cited by examiner

*Primary Examiner* — Don Le
(74) *Attorney, Agent, or Firm* — Sughrue Mion, PLLC

(57) ABSTRACT

An antenna system including at least one flexible dielectric sheet, a plurality of individual antennas mounted on the at least one flexible dielectric sheet, a feed network mounted on the at least one flexible dielectric sheet, the feed network being connected to and feeding the individual antennas and at least one conductive ground plane mounted on the at least one flexible dielectric sheet.

25 Claims, 8 Drawing Sheets

MULTI-ANTENNA MULTIBAND SYSTEM

REFERENCE TO RELATED APPLICATIONS

Reference is hereby made to U.S. Provisional Patent Application 61/180,472, entitled MULTI BANDS, MULTI ANTENNA, ARRANGEMENT FOR WIRELESS DEVICE, filed May 22, 2009 and to U.S. Provisional Patent Application 61/270,200, entitled MULTI-ANTENNA MULTIBAND SYSTEM, filed Jul. 2, 2009, the disclosures of which are hereby incorporated by reference and priorities of which are hereby claimed pursuant to 37 CFR 1.78(a)(4) and (5)(i).

FIELD OF THE INVENTION

The present invention relates generally to antennas and more particularly to an antenna system including multiple antennas capable of operating at different frequency bands.

BACKGROUND OF THE INVENTION

The following Patent documents are believed to represent the current state of the art:
U.S. Pat. No. 5,684,672 and U.S. 2009/0316612.

SUMMARY OF THE INVENTION

The present invention seeks to provide an improved low-profile antenna system including multiple antennas capable of operating at different frequency bands, for use in wireless communication devices.

There is thus provided in accordance with a preferred embodiment of the present invention an antenna system including at least one flexible dielectric sheet, a plurality of individual antennas mounted on the at least one flexible dielectric sheet, a feed network mounted on the at least one flexible dielectric sheet, the feed network being connected to and feeding the individual antennas and at least one conductive ground plane mounted on the at least one flexible dielectric sheet.

In accordance with a preferred embodiment of the present invention the feed network includes conducting lines.

Preferably, the conducting lines include at least one of striplines, microstriplines and coplanar waveguides.

Preferably, the conducting lines are galvanically connected to the plurality of individual antennas.

In accordance with another preferred embodiment of the present invention, the antenna system also includes at least one transceiver, the at least one transceiver being galvanically coupled to the plurality of individual antennas by way of the conducting lines.

Preferably, each one of the plurality of individual antennas is connected to the at least one transceiver by a single one of the conducting lines.

Alternatively, more than one of the plurality of individual antennas is connected to the at least one transceiver by a single one of the conducting lines.

Preferably, the conducting lines are shaped so that a conductive path between the plurality of individual antennas and the at least one transceiver is as short as possible.

In accordance with a further preferred embodiment of the present invention the at least one flexible dielectric sheet has two-dimensional geometry. Alternatively, the at least one flexible dielectric sheet has three-dimensional geometry.

Preferably, the plurality of individual antennas, the feed network and the at least one conductive ground plane are mounted on the at least one flexible dielectric sheet by a method selected from a group of methods including compression, painting, coating, deposition, conductive ink printing, sputtering, cementing and etching.

Preferably, the plurality of individual antennas, the feed network and the at least one conductive ground plane are mounted on a common surface of the at least one flexible dielectric sheet.

Alternatively, the plurality of individual antennas, the feed network and the at least one conductive ground plane are mounted on different surfaces of the at least one flexible dielectric sheet.

Preferably, the at least one flexible dielectric sheet includes two flexible dielectric sheets having connecting surfaces.

In accordance with yet another preferred embodiment of the present invention the at least one conductive ground plane includes a single conductive ground plane, which single conductive ground plane preferably acts as a common conductive ground plane for the plurality of individual antennas.

Additionally or alternatively, the at least one conductive ground plane includes a plurality of individual conductive ground planes, wherein each one of the plurality of individual conductive ground planes corresponds to a respective one of the plurality of individual antennas.

Preferably, the individual antennas are configured to operate at different respective frequency bands.

Preferably, the frequency bands lie between about 700 MHz and 10 GHz. In accordance with yet a further preferred embodiment of the present invention, a wireless communication device includes the antenna system.

Preferably, the wireless communication device includes a computer having a screen.

Preferably, the antenna system is located behind the screen.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
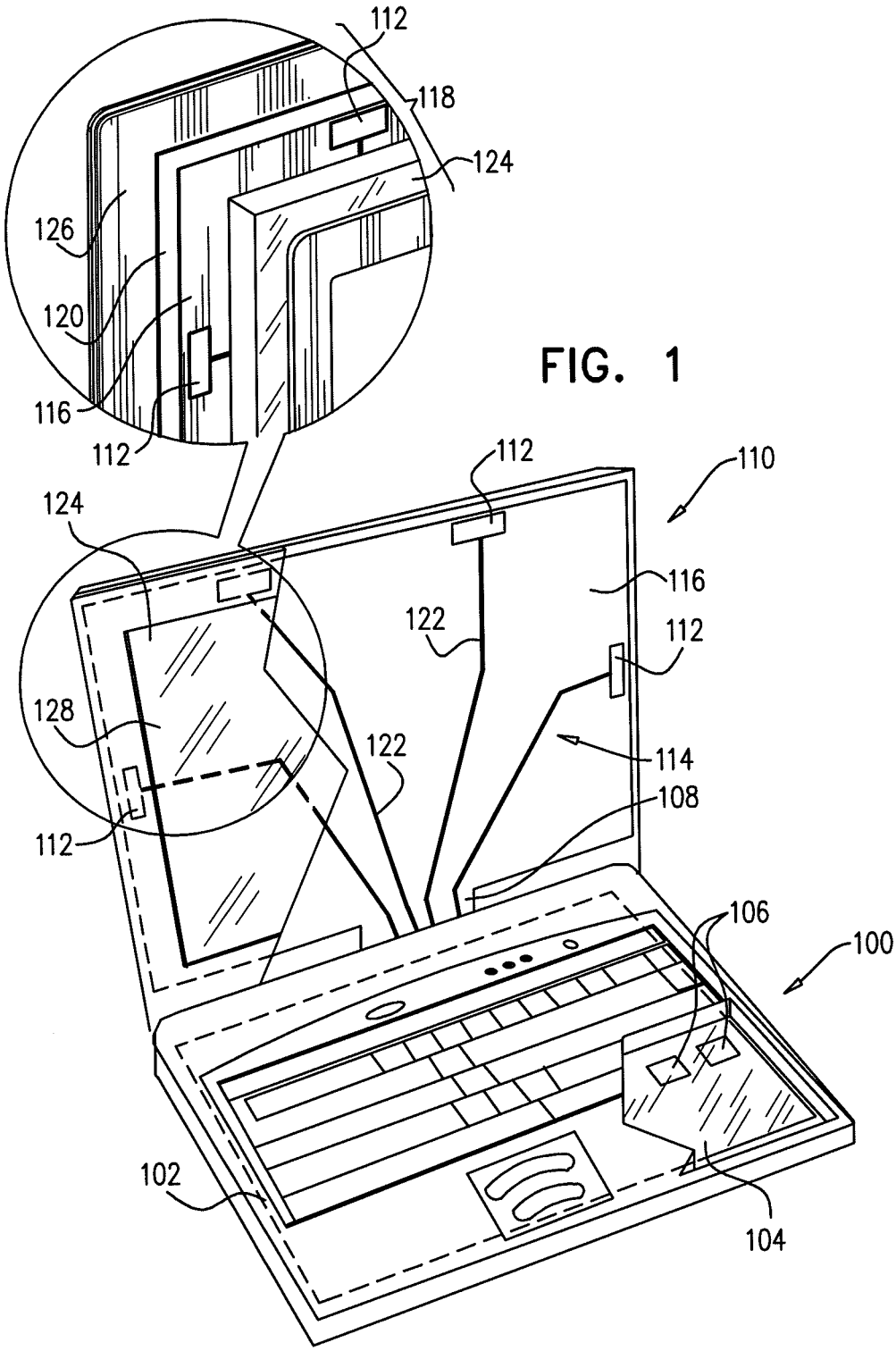
FIG. 1 is a simplified pictorial illustration of a wireless communication device including an antenna system constructed and operative in accordance with a preferred embodiment of the present invention.

Reference is now made to FIG. 1, which is a simplified pictorial illustration of a wireless communication device 100 including an antenna system constructed and operative in accordance with a preferred embodiment of the present invention. In the embodiment illustrated in FIG. 1, wireless communication device 100 is a laptop computer configured to employ the antenna system of the present invention in its operation. However, it is appreciated that device 100 may comprise other types of wireless communication devices, including a cellular phone or personal digital assistant (PDA).

Device 100 preferably includes a base 102, which base 102 is shown having a cut-away section 104 within which are preferably located a number of internal transceivers 106. By way of example in FIG. 1 two transceivers 106 are shown, although it is appreciated that the inclusion of more or fewer transceivers is possible. Transceivers 106 preferably operate in one or more frequency bands, which frequency bands typically lie between approximately 2 GHz and 5 GHz. It is appreciated, however, that transceivers 106 may also operate in frequency bands outside this range, such as in the cellular telephone bands of 824 MHz-920 MHz and 1710 MHz-2170 MHz, in the wireless local area network (WLAN) bands and in bands above 5 GHz, including bands at approximately 10 GHz.

In order to receive and transmit radiation in the appropriate frequency bands of operation, transceivers 106 are preferably galvanically connected via a connection tab 108 to an antenna system 110.

Antenna system 110 includes a plurality of individual antennas 112 connected to and fed by a feed network 114, the antennas 112 and feed network 114 being mounted on a surface of a flexible dielectric sheet 116. As seen most clearly at enlargement 118, antenna system 110 further includes a conductive ground plane 120 mounted on sheet 116, which conductive ground plane 120 preferably acts as common conductive ground plane for all of antennas 112 and feed network 114. Antennas 112 and conductive ground plane 120 may be mounted on opposite surfaces of sheet 116, as illustrated in FIG. 1, or may be mounted on a common surface of sheet 116, as is described below in reference to other embodiments of the present invention.

The mounting of antennas 112, feed network 114 and conductive ground plane 120 on a single flexible sheet 116 allows antenna system 110 to be formed as a flexible low-cost unit, which unit may be easily installed into a variety of wireless communication devices and connected to transceivers, such as transceivers 106, therein. Furthermore, depending on design requirements and due to the flexibility of sheet 116, antenna system 110 may be employed in a two-dimensional mode, as in FIG. 1 wherein sheet 116 has two-dimensional geometry, or in a three-dimensional mode, wherein sheet 116 has three-dimensional geometry.

As is described in more detail below, antennas 112 are operative to receive and transmit electromagnetic radiation in the one or more frequency bands at which transceivers 106 operate. Antennas 112 are preferably galvanically connected to transceivers 106 by feed network 114, which feed network 114 preferably includes a multiplicity of conducting lines 122. Conducting lines 122 may be embodied as striplines, microstriplines, and/or coplanar waveguides (CPWs). The use of striplines, microstriplines, and/or CPWs in antenna system 110, as opposed to conventionally employed coaxial cables, serves to significantly reduce both the profile of antenna system 110 and the length of the conducting lines 122 between antennas 112 and transceivers 106, thereby making antenna system 110 more compact and improving its performance.

Antenna system 110 is preferably located between a screen 124 and an outer plastic casing 126 of device 100, as shown at a section 128 of screen 124 where broken lines are used to outline elements of antenna system 110 located behind screen 124. Alternatively, antenna system 110 may be at least partially located external to device 100 and/or on an external surface of the device.

The flexible sheet 116 forming antenna system 110 is preferably in the form of a rectangle (excluding connection tab 108) having approximate dimensions of 200 mm×300 mm. However, it is understood that these dimensions of sheet 116 are exemplary only and that the actual dimensions of sheet 116 will be typically set so as to correspond to the dimensions of the device within which antenna system 110 is to be installed. Similarly, the location of antenna system 110 is purely exemplary. Thus, if antenna system 110 were to be installed in a PDA, the dimensions of the flexible sheet forming the system would typically be significantly smaller than those stated above and the antenna system would not necessarily be located behind the screen of the PDA.

Figure 2:
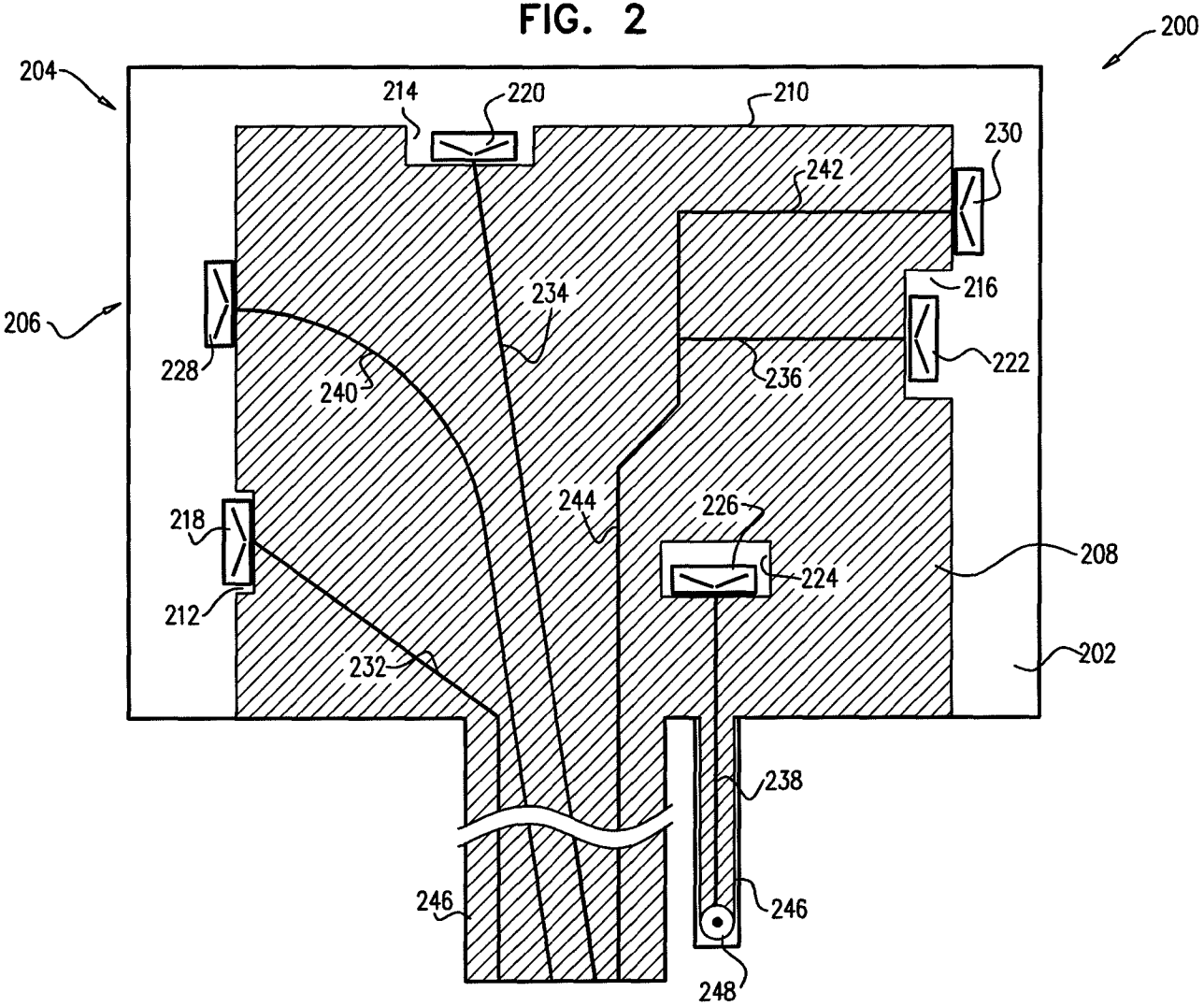
FIG. 2 is a schematic top view illustration of an antenna system constructed and operative in accordance with another preferred embodiment of the present invention.

Reference is now made to FIG. 2, which is a schematic top view illustration of an antenna system constructed and operative in accordance with another preferred embodiment of the present invention.

As seen in FIG. 2, there is provided an antenna system 200, including a flexible dielectric sheet 202 upon which other elements of antenna system 200 are mounted. The term 'mounted' as used herein refers to a range of possible attachment modes including, but not limited to, compression, painting, coating, deposition, conductive ink printing, sputtering, cementing and etching.

Sheet 202 is preferably a single sheet, preferably formed from a polycarbonate material approximately 50 μm thick and has an upper surface 204 and a lower surface 206. FIG. 2 is a top view of antenna system 200 from above surface 204 of sheet 202. For illustrative purposes only, sheet 202 is shown as being transparent, so that elements of antenna system 200 mounted on both upper surface 204 and on lower surface 206 of sheet 202 are visible.

A conductive ground plane 208 is preferably mounted on lower surface 206 of sheet 202. Ground plane 208 is preferably formed by the sputtering of copper onto surface 206, the sputtering generating a layer of negligible resistance having a thickness selected so that the flexibility of sheet 202 is not significantly reduced. In the embodiment described herein, the thickness of the copper layer is approximately 8 μm, and the copper has a resistivity of the order of $1.7\times10^{-8}$ Ωm.

Ground plane 208 has a perimeter 210 within which are preferably formed rectangular recesses 212, 214 and 216, within which recesses individual antennas 218, 220 and 222 are preferably located. In addition, ground plane 208 preferably has an opening 224, wherein is formed another antenna 226. A further two antennas, 228 and 230 are preferably formed outside perimeter 210. As is clear from FIG. 2, ground plane 208 acts as a common ground plane for all of antennas 218, 220, 222, 226, 228 and 230.

In the embodiment shown in FIG. 2, antennas 218, 220, 222, 226, 228 and 230 are illustrated, for the sake of simplicity, as being v-shaped dipoles. However, it is appreciated that a variety of other types of antennas, including more complex antennas, may be included in antenna system 200 and that antennas 218, 220, 222, 226, 228 and 230 are preferably configured to operate at different frequency bands of operation.

Antennas 218-230 are preferably galvanically connected to at least one transceiver (not shown) by a feed network including number of respective conducting lines 232, 234, 236, 238, 240 and 242, of which conducting lines 236 and 242 preferably merge to form a common conducting line 244.

Conducting lines 232, 234, 236, 238, 240, 242 and 244 are preferably formed as conducting strips on upper surface 204 of sheet 202, whereby, in combination with ground plane 208, they constitute microstriplines. Alternatively, conducting lines 232, 234, 236, 238, 240, 242 and 244 may be implemented as CPWs, by forming the lines on lower surface 206 of sheet 202 and providing insulating gaps between the lines and ground plane 208.

As exemplified by conducting lines 232, 234, 238 and 240, a single microstripline may be provided for each antenna. Alternatively, a single microstripline may be used to couple more than one antenna to the at least one transceiver, as exemplified by conducting line 244, which acts as a single microstripline connecting antennas 222 and 230, via conducting lines 236 and 242, to the at least one transceiver.

Conducting lines 232, 234, 236, 238, 240, 242 and 244 may be straight or curved and are preferably designed so that a path of the line between an antenna and the transceiver to which it is connected is as short as possible.

Conducting lines 232, 234, 236, 238, 240, 242 and 244 are preferably galvanically connected to the at least one transceiver by way of a number of connection tabs 246 extending from the base of sheet 202. The connection between the conducting lines 232, 234, 236, 238, 240, 242 and 244 and the at least one transceiver may take the form of any galvanic connection, including via a coaxial connector, as shown by way of example in the case of conducting line 238 which terminates in a coaxial connector 248.

Figure 3:
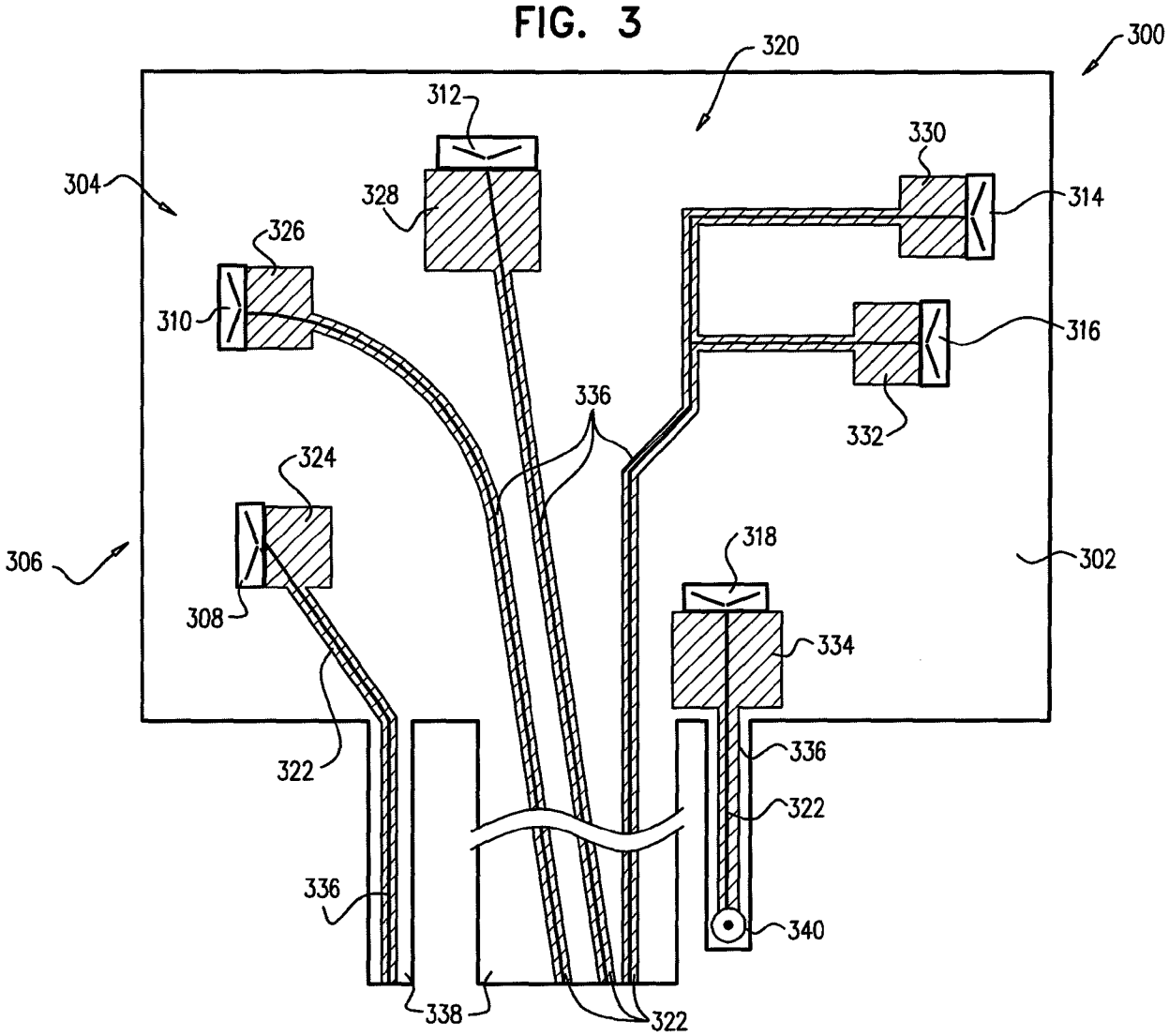
FIG. 3 is a schematic top view illustration of an antenna system constructed and operative in accordance with yet another preferred embodiment of the present invention.

Reference is now made to FIG. 3, which is a schematic top view illustration of an antenna system constructed and operative in accordance with yet another preferred embodiment of the present invention.

As seen in FIG. 3, there is provided an antenna system 300, including a flexible dielectric sheet 302 having an upper surface 304 and a lower surface 306. A plurality of individual antennas 308, 310, 312, 314, 316 and 318 is preferably mounted on upper surface 304 of sheet 302 and is preferably connected to and fed by a feed network 320, which feed network 320 preferably includes a number of conducting lines 322.

In contrast to antenna system 200 of FIG. 2 in which a single conductive ground plane 208 is present, in antenna system 300 each of individual antennas 308, 310, 312, 314, 316 and 318 preferably has a corresponding respective individual ground plane 324, 326, 328, 330, 332 and 334 which ground planes 324-334 are preferably mounted on lower surface 306 of sheet 302.

Ground planes 324-334 each preferably has a length of the order of ¼ $\lambda_d$, where $\lambda_d$ a is the wavelength in a medium of a frequency at which the antenna corresponding to the respective ground plane operates. Ground planes 324-334 are preferably continuous with conducting ground plane regions 336.

Other features and advantages of antenna system 300 are generally similar to those described above in reference to antenna system 200, including the provision of conductive tabs 338 via which conducting lines 322 are preferably galvanically connected to at least one transceiver (not shown) and the presence of a coaxial connection 340 at which the conducting line 322 feeding antenna 318 may terminate.

It is appreciated that whereas antenna system 200 of FIG. 2 may have substantially similar operating characteristics to antenna system 300 of FIG. 3, antenna system 300 has the advantage of requiring less conductive ground plane material. It is also appreciated that the two embodiments 200 and 300 of the antenna system of the present invention are not mutually exclusive. Rather, included within the scope of the present invention are embodiments of an antenna system formed partially with individual ground planes for the antennas, as in antenna system 300, and partially with a relatively large single common ground plane, as in antenna system 200.

In the description of the following embodiments of the present invention, antenna systems are shown as having a single common ground plane, in accordance with the design of antenna system 200. However, those having ordinary skill in the art will be able to adapt the description to a form generally similar to that of antenna system 300, wherein separate antennas each have separate respective ground planes.

Figure 4A:
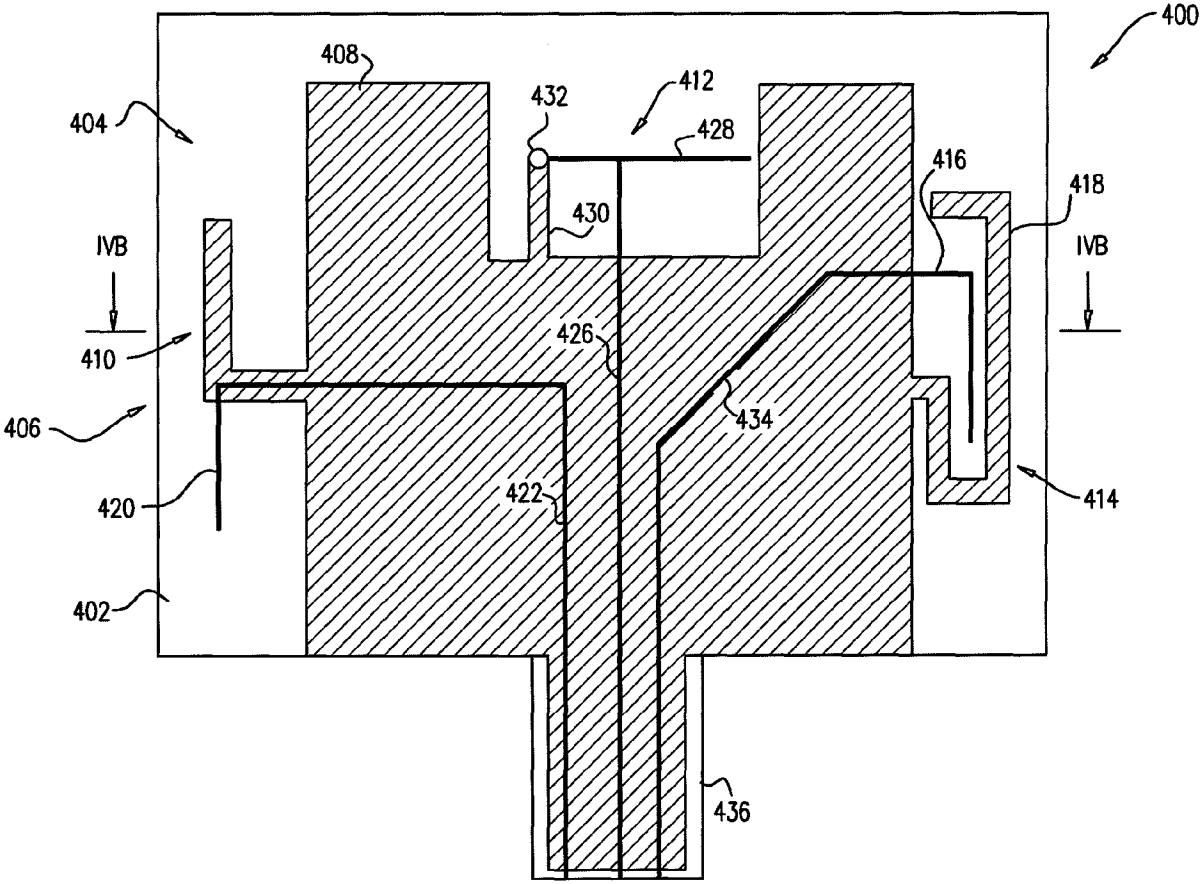
FIGS. 4A and 4B are respective schematic top view and cross-sectional view illustrations of an antenna system constructed and operative in accordance with still another preferred embodiment of the present invention.
Figure 4B:
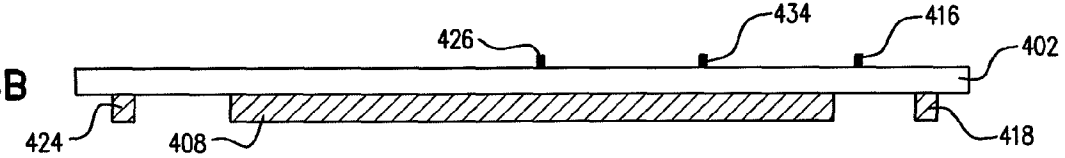

Reference is now made to FIGS. 4A and 4B which are respective schematic top view and cross-sectional view illustrations of an antenna system constructed and operative in accordance with still another preferred embodiment of the present invention.

As seen in FIGS. 4A and 4B, there is provided an antenna system 400. Antenna system 400 is generally similar in construction to antenna system 200 of FIG. 2 and includes a flexible dielectric sheet 402 having an upper surface 404 and a lower surface 406. A conductive ground plane 408 is preferably mounted on lower surface 406 of sheet 402.

Antenna system 400 preferably includes three individual antennas: a simple dipole 410, an inverted-F antenna 412, and an antenna 414 having a monopole 416 and a coupling element 418.

Dipole 410 preferably comprises two monopole arms: a first monopole arm 420 formed on upper surface 404 of sheet 402 and connected to a conducting line 422 and a second monopole arm 424 formed on lower surface 406 of sheet 402 and galvanically connected to ground plane 408. The two monopole arms 420 and 424 are preferably approximately mirror images of each other and typically have lengths of the order of $$\frac{1}{4}\lambda_d,$$

where $\lambda_d$ is the wavelength in a medium corresponding to an operating frequency of dipole 410. Monopole arms 420 and 424 are preferably located a distance $$\frac{1}{4}\lambda_d$$

from the edge of ground plane 408.

Inverted-F antenna 412 is preferably fed by a conducting line 426, which continues as an arm 428 of the "F." Conducting line 426 and arm 428 are both preferably formed on upper surface 404 of sheet 402. A ground portion 430 of antenna 412 is preferable formed on lower surface 406 of sheet 402 and galvanically connected to ground plane 408. The end of arm 428 is preferably galvanically connected to ground portion 430 by a conducting via 432.

Antenna 414 is generally similar in construction and operation to antennas described in PCT application PCT/IL2007/001420, assigned to the same assignee as the present invention and incorporated herein by reference. Monopole 416 is preferably fed by a conducting line 434 and both the monopole 416 and conducting line 434 are preferably formed on upper surface 404 of sheet 402. Coupling element 418 is preferably formed on lower surface 406 of sheet 402 and is galvanically connected to ground plane 408.

Conducting lines 422, 426 and 434 are preferably insulated from and located above ground plane 408, thus constituting microstriplines. The conducting lines are preferably coupled to transceivers (not shown) by way of a connection tab 436.

Other features and advantages of antenna system 400 are substantially as described above in reference to antenna systems 100 and 200 of FIGS. 1 and 2.

Figure 5A:
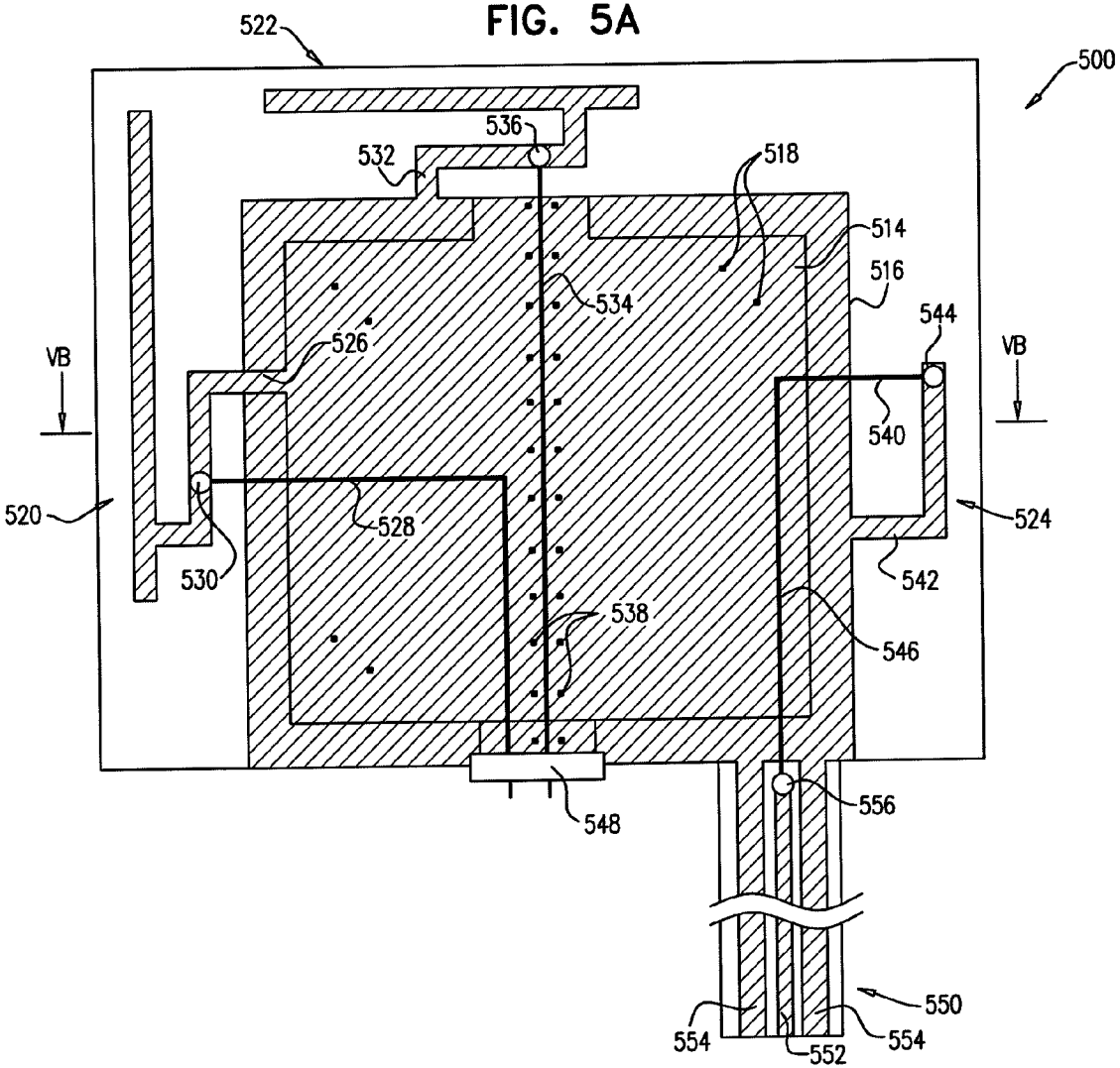
FIGS. 5A, 5B and 5C are respective schematic top view, cross-sectional view and expanded cross-sectional view illustrations of an antenna system constructed and operative in accordance with a further preferred embodiment of the present invention.
Figure 5B:
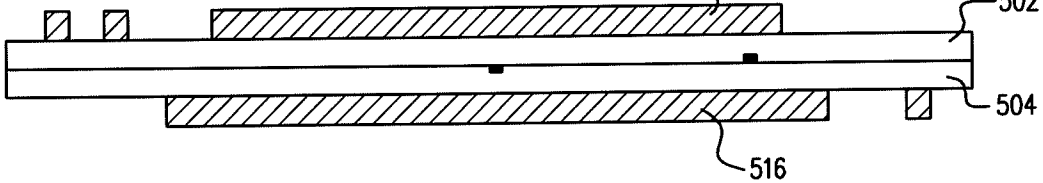
Figure 5C:
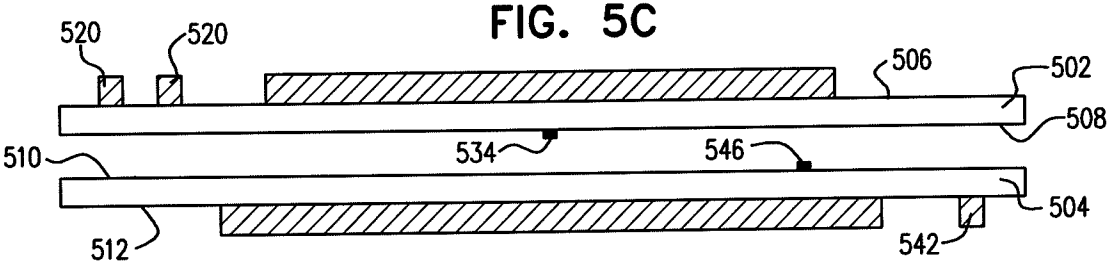

Reference is now made to FIGS. 5A, 5B and 5C which are respective schematic top view, cross-sectional view and expanded cross-sectional view illustrations of an antenna system constructed and operative in accordance with a further preferred embodiment of the present invention.

As seen in FIGS. 5A-5C there is provided an antenna system 500. In contrast to antenna systems 200, 300 and 400 of FIGS. 2, 3 and 4 in which only a single dielectric sheet is present, antenna system 500 preferably includes a first dielectric sheet 502 and a second dielectric sheet 504. First sheet 502 has an upper surface 506 and a lower surface 508 and second sheet 504 has an upper surface 510 and a lower surface 512. A first ground plane 514 is preferably formed on upper surface 506 of sheet 502 and a second ground plane 516 is preferably formed on lower surface 512 of sheet 504. The first and second ground planes 514 and 516 preferably have substantially similar properties as ground plane 208 of FIG. 2 and are preferably mutually connected by way of a number of vias 518.

Antenna system 500 is typically produced by forming the two sheets 502 and 504 separately and subsequently attaching them to each other, for example by means of cementing.

Antenna system 500 preferably includes three individual antennas: a first planar inverted-F antenna (PIFA) 520, a second PIFA 522 and a loop antenna 524.

PIFAs 520 and 522 preferably have similar configurations but different dimensions, thereby allowing them to operate in different frequency bands. In addition, PIFAs 520 and 522 may be oriented differently to each other, as illustrated in FIG. 5A, wherein PIFAs 520 and 522 oriented orthogonally to each other.

The elements of PIFA 520 are preferably formed on upper surface 506 of sheet 502 and are preferably galvanically connected to ground plane 514 at a ground point 526. PIFA 520 is preferably fed by a conducting line 528, which conducting line 528 is formed on lower surface 508 of sheet 502. Conducting line 528 is preferably connected to the elements of PIFA 520 by way of a via 530 which acts as a feed point of PIFA 520.

The elements of PIFA 522 are preferably formed on lower surface 512 of sheet 504 and are preferably galvanically connected to ground plane 516 at a ground point 532. PIFA 522 is preferably fed by a conducting line 534, which conducting line 534 is formed on lower surface 508 of sheet 502. Conducting line 534 is preferably connected to the elements of PIFA 522 by way of a via 536 which acts as a feed point of PIFA 522. Conducting line 534 may have two sets of parallel vias 538 located on either side of the line, in order to improve the performance of conducting line 534. It is appreciated that although vias 538 are shown in FIG. 5A as being located in proximity to conducting line 534 only, similar vias may be located in proximity to any of the other conducting lines included in antenna system 500.

A first element 540 of loop antenna 524 is preferably formed on upper surface 510 of sheet 504 and a second element 542 of loop antenna 524 is preferably formed on lower surface 512 of sheet 504. The two elements 540 and 542 are preferably connected together by way of a via 544 which penetrates sheet 504. Loop antenna 524 is preferably fed by a conducting line 546, which is formed on upper surface 510 of sheet 504.

Conducting lines 528, 534 and 546 are each insulated from and positioned between ground planes 514 and 516 so that in combination with ground planes 514 and 516 the lines constitute striplines.

Conducting lines 528, 534 and 546 may be connected to transceivers (not shown) by any suitable galvanic connection system, such as by way of the connection tabs described above with reference to antenna systems 200, 300 and 400. In the embodiment illustrated in FIG. 5A conducting lines 528 and 534 are shown, by way of example, as being connected to transceivers by a connector 548, which connector 548 may be attached to sheet 502 and/or 504.

Also by way of example, conducting line 546 is shown as being attached to a transceiver (not shown) by way of a CPW 550. CPW 550 extends from sheet 504 and includes a central conducting line 552 flanked on either side by conducting ground planes 554. Conducting ground planes 554 are preferably galvanically connected to ground plane 516. A via 556 connects conducting line 546 to central conducting line 552. Alternatively, a microstripline may be used in place of CPW 550.

With the exception of the differences outlined above, other features and advantages of antenna system 500 are substantially as described above in reference to antenna systems 100 and 200 of FIGS. 1 and 2.

Figure 6A:
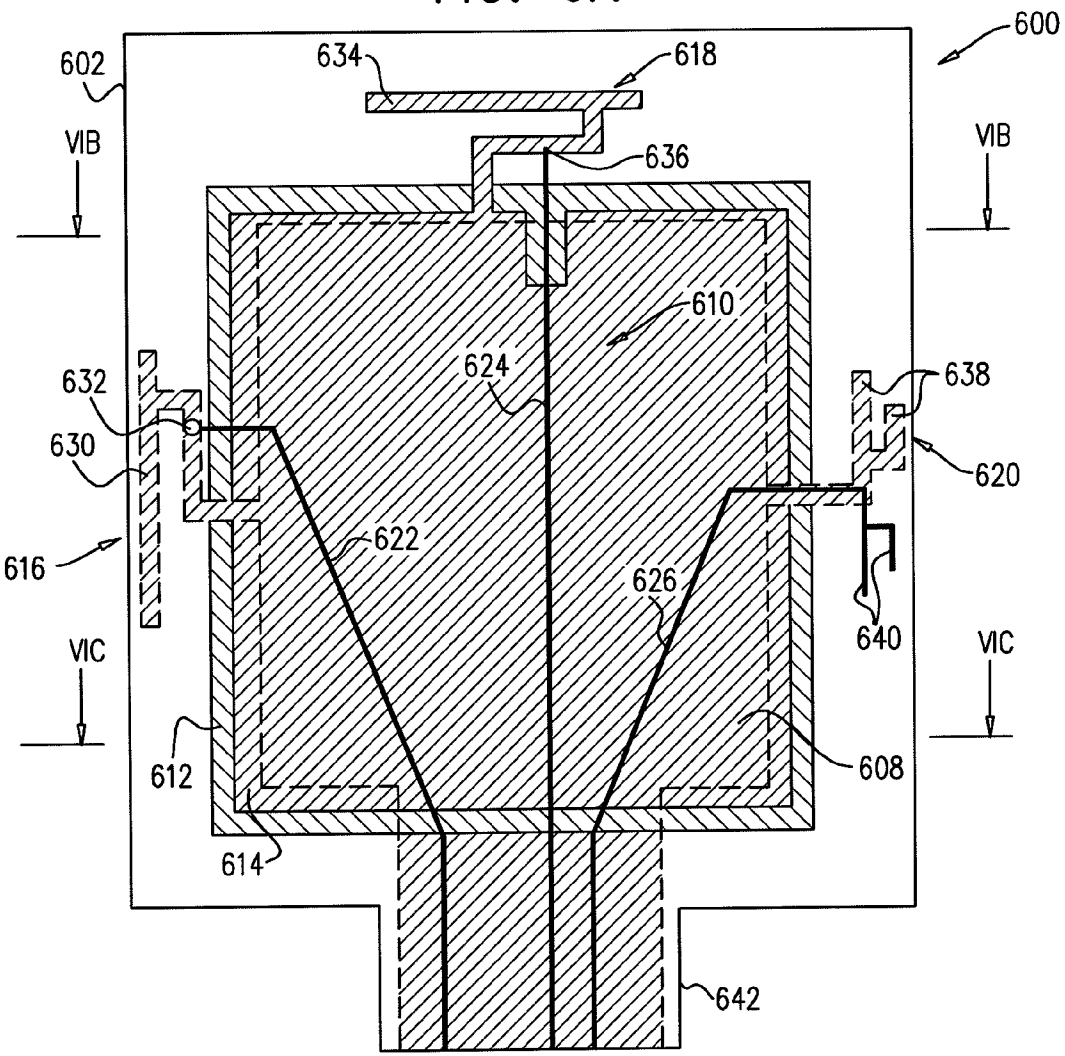
FIGS. 6A, 6B and 6C are respective schematic top view and cross-sectional view illustrations of an antenna system constructed and operative in accordance with yet a further preferred embodiment of the present invention.
Figure 6B:
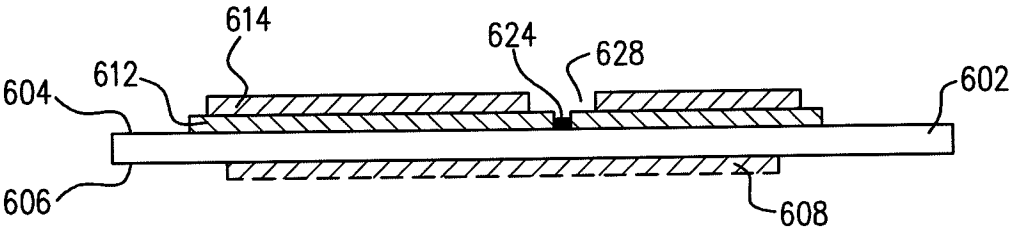
Figure 6C:
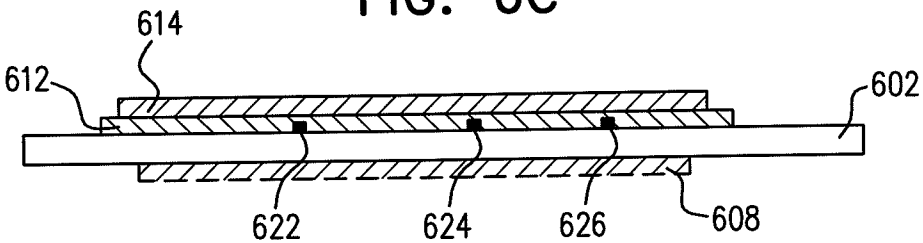

Reference is now made to FIGS. 6A, 6B and 6C which are respective schematic top view and two cross-sectional view illustrations of an antenna system constructed and operative in accordance with yet a further preferred embodiment of the present invention.

As seen in FIGS. 6A-6C, there is provided an antenna system 600 including a single flexible dielectric sheet 602 having an upper surface 604 and a lower surface 606. Sheet 602 is generally similar in properties and features to sheet 202 of FIG. 2. In FIGS. 6A-6C broken lines are used to outline elements of antenna system 600 formed on lower surface 606 of sheet 602 in order to distinguish these elements from elements formed on upper surface 604 of sheet 602, which elements are outlined by solid lines.

Antenna system 600 is typically formed by the sequential deposition of several layers onto sheet 602. A first ground plane 608 is preferably formed on lower surface 606 of sheet 602 and a feed network 610 is preferably formed on upper surface 604 of sheet 602. Subsequently, a dielectric layer 612 is formed on surface 604, covering as necessary sections of feed network 610. Finally, a second ground plane 614 is formed on an upper surface of dielectric layer 612. Ground planes 608 and 614 preferably have generally similar properties to those of ground plane 208 in FIG. 2.

Antenna system 600 preferably includes three individual antennas: two inverted F antennas 616 and 618 and a multiband dipole antenna 620. Antennas 616, 618 and 620 are preferably formed outside the perimeters of ground planes 608 and 614 and are fed by feed network 610. Specifically, antenna 616 is fed by a conducting line 622, antenna 618 is fed by a conducting line 624 and antenna 620 is fed by a conducting line 626. Conducting lines 622, 624 and 626 are preferably formed on upper surface 604 of sheet 602 and overlaid by dielectric layer 612, as described above, except at indentation 628 in the region of antenna 618 where conducting line 624 is exposed, as seen most clearly in FIG. 6B. Thus, conducting lines 622 and 626 and the non-exposed portion of conducting line 624 constitute striplines, whereas the portion of conducting line 624 exposed at indentation 628 constitutes a microstripline.

Inverted F antenna 616 includes a conducting element 630 preferably formed on lower surface 606 of sheet 602 and continuous with ground plane 608. Conducting line 622 feeding antenna 616 is preferably connected to it by way of a via 632 which acts as a feed point for antenna 616.

Inverted F antenna 618 includes a conducting element 634 preferably formed on upper surface 604 of sheet 602 and continuous with ground plane 614. Conducting line 624 feeding antenna 618 is preferably connected to it at a feed point 636.

Multiband dipole antenna 620 includes a first set of arms 638 and a second set of arms 640. First set of arms 638 is preferably formed on lower surface 606 of sheet 602 and is preferably continuous with ground plane 608. Second set of arms 640 is preferably formed on upper surface 604 of sheet 602 and is preferably continuous with and fed by conducting line 626.

Conducting lines 622, 624 and 626 are preferably connected to transceivers (not shown) by way of a connection tab 642 extending from the base of sheet 602.

With the exception of the differences outlined above, other features and advantages of antenna system 600 are substantially as described above in reference to antenna systems 100 and 200 of FIGS. 1 and 2.

It will be appreciated that although specific types of antennas have been described herein as being suitable for incorporation into the antenna system of the present invention, the antenna system of the present invention is not limited to use with these types of antennas only. Rather, embodiments of the present invention may be implemented for substantially any suitable configuration of antenna. In addition, it will be understood that connecting lines feeding the antennas may be implemented as substantially any type of galvanic connection known in the art, including, but not limited to, striplines, microstriplines, CPWs and any combination thereof.

It will further be appreciated by persons skilled in the art that the present invention is not limited by what has been particularly claimed hereinbelow. Rather the scope of the present invention includes various combinations and subcombinations of the features described hereinabove as well as modifications and variations thereof as would occur to persons skilled in the art upon reading the foregoing description with reference to the drawings and which are not in the prior art.

The invention claimed is:

1. An antenna system comprising:

at least one flexible dielectric sheet;

a plurality of individual antennas mounted on said at least one flexible dielectric sheet;

a feed network mounted on said at least one flexible dielectric sheet, said feed network being connected to and feeding said individual antennas; and at least one conductive ground plane mounted on said at least one flexible dielectric sheet, at least one of said plurality of individual antennas being located in at least one of an opening in said at least one conductive ground plane and a recess formed in a perimeter of said at least one conductive ground plane.

2. An antenna system according to claim 1, wherein said feed network comprises conducting lines.

3. An antenna system according to claim 2, wherein said conducting lines comprise at least one of striplines, microstriplines and coplanar waveguides.

4. An antenna system according to claim 3, wherein said conducting lines are galvanically connected to said plurality of individual antennas.

5. An antenna system according to claim 4, also comprising at least one transceiver, said at least one transceiver being galvanically coupled to said plurality of individual antennas by way of said conducting lines.

6. An antenna system according to claim 5, wherein each one of said plurality of individual antennas is connected to said at least one transceiver by a single one of said conducting lines.

7. An antenna system according to claim 5, wherein more than one of said plurality of individual antennas is connected to said at least one transceiver by a single one of said conducting lines.

8. An antenna system according to claim 5, wherein said conducting lines are shaped so that a conductive path between said plurality of individual antennas and said at least one transceiver is as short as possible.

9. An antenna system according to claim 1, wherein said at least one flexible dielectric sheet has two-dimensional geometry.

10. An antenna system according to claim 1, wherein said at least one flexible dielectric sheet has three-dimensional geometry.

11. An antenna system according to claim 1, wherein said plurality of individual antennas, said feed network and said at least one conductive ground plane are mounted on said at least one flexible dielectric sheet by a method selected from a group of methods including compression, painting, coating, deposition, conductive ink printing, sputtering, cementing and etching.

12. An antenna system according to claim 11, wherein said plurality of individual antennas, said feed network and said at least one conductive ground plane are mounted on a common surface of said at least one flexible dielectric sheet.

13. An antenna system according to claim 11, wherein said plurality of individual antennas, said feed network and said at least one conductive ground plane are mounted on different surfaces of said at least one flexible dielectric sheet.

14. An antenna system according to claim 1, wherein said at least one flexible dielectric sheet comprises two flexible dielectric sheets having connecting surfaces.

15. An antenna system according to claim 1, wherein said at least one conductive ground plane comprises a single conductive ground plane.

16. An antenna system according to claim 15, wherein said single conductive ground plane acts as a common conductive ground plane for said plurality of individual antennas.

17. An antenna system according to claim 1, wherein said at least one conductive ground plane comprises a plurality of individual conductive ground planes, wherein each one of said plurality of individual conductive ground planes corresponds to a respective one of said plurality of individual antennas.

18. An antenna system according to claim 1, wherein said individual antennas are configured to operate at different respective frequency bands.

19. An antenna system according to claim 18, wherein said frequency bands lie between about 700 MHz and 10 GHz.

20. A wireless communication device including the antenna system of claim 1.

21. A wireless communication device according to claim 20, wherein said wireless communication device comprises a computer having a screen.

22. A wireless communication device according to claim 21, wherein said antenna system is located behind said screen.

23. An antenna system according to claim 2 wherein at least two of said conducting lines merge to form a common conducting line.

24. An antenna system according to claim 1 wherein said at least one of said plurality of individual antennas is located in an opening in said at least one conductive ground plane.

25. An antenna system according to claim 1 wherein said at least one of said plurality of individual antennas is located in a recess formed in a perimeter of said at least one conductive ground plane.

* * * * *